US005451990A

United States Patent [19]

Sorenson et al.

[11] Patent Number: 5,451,990

[45] Date of Patent: Sep. 19, 1995

[54] REFERENCE PATTERN FOR USE IN ALIGNING MULTIPLE INKJET CARTRIDGES

[75] Inventors: Paul R. Sorenson; Keith E. Cobbs, both of San Diego; Robert Beauchamp, Carlsbad, all of Calif.

[73] Assignee: Hewlett-Packard Company, Palo Alto, Calif.

[21] Appl. No.: 56,325

[22] Filed: Apr. 30, 1993

[51] Int. Cl.[6] ..... B41J 23/00

[52] U.S. Cl. ..... 347/37; 347/19; 347/107

[58] Field of Search ..... 346/1.1, 75, 140 R; 250/548, 568; 356/401; 347/9, 10, 37, 39

[56] References Cited

U.S. PATENT DOCUMENTS

| | | | |
|---|---|---|---|
| 4,222,060 | 9/1980 | Sato et al. | 347/9 |
| 4,449,052 | 5/1984 | Krieg | 250/568 |
| 4,524,364 | 6/1985 | Bain et al. | 347/10 |
| 4,878,063 | 10/1989 | Katerburg | 346/140 R X |
| 5,172,190 | 12/1992 | Kaiser | 356/401 |
| 5,216,257 | 6/1993 | Brueck et al. | 356/401 X |

*Primary Examiner*—Benjamin R. Fuller

*Assistant Examiner*—John E. Barlow

[57] ABSTRACT

A test pattern for use with an optical sensor for an inkjet printer. The inventive pattern comprises a first plurality of vertical bars horizontally spaced and a second plurality of horizontal bars vertically spaced. The spacing between the bars is approximately equal to the width of the bars. In a particular implementation, the pattern is adapted for use with an inkjet printer having a plurality of pens. The first plurality of bars includes a first set of bars printed by each of the pens. The first plurality of bars includes a second set of bars printed by one of the pens moving at at least two different horizontal speeds. The second plurality of bars includes one column of vertically spaced bars for each of the pens. Each column of vertically spaced bars includes a first plurality of vertically spaced bars printed by a first pen. A respective column of vertically spaced bars includes a second plurality of vertically spaced bars printed by a respective one of the pens. Each column of vertically spaced bars includes a third plurality of vertically spaced bars printed by the first pen. The inventive pattern allows for considerable information with respect to pen alignments to be determined by optical scanning.

2 Claims, 14 Drawing Sheets

FIG. 3
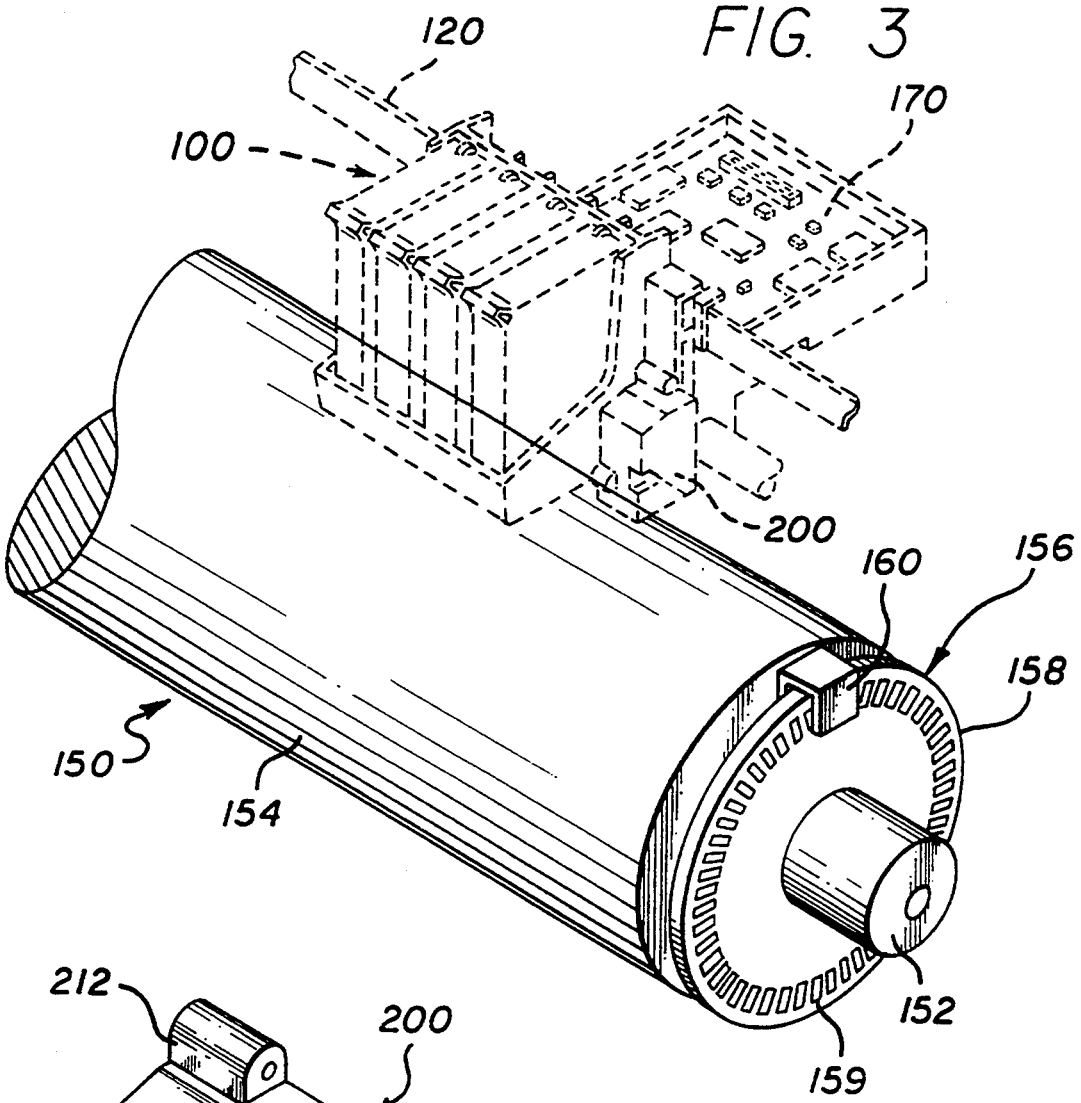
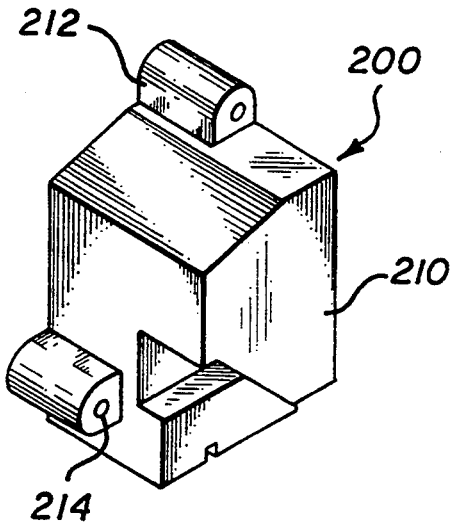
FIG. 6a
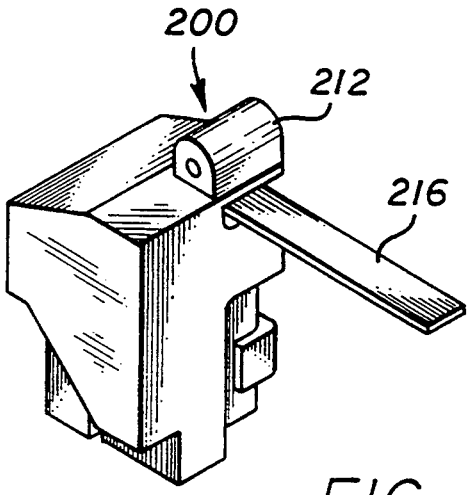
FIG. 6b

FIG. 6c
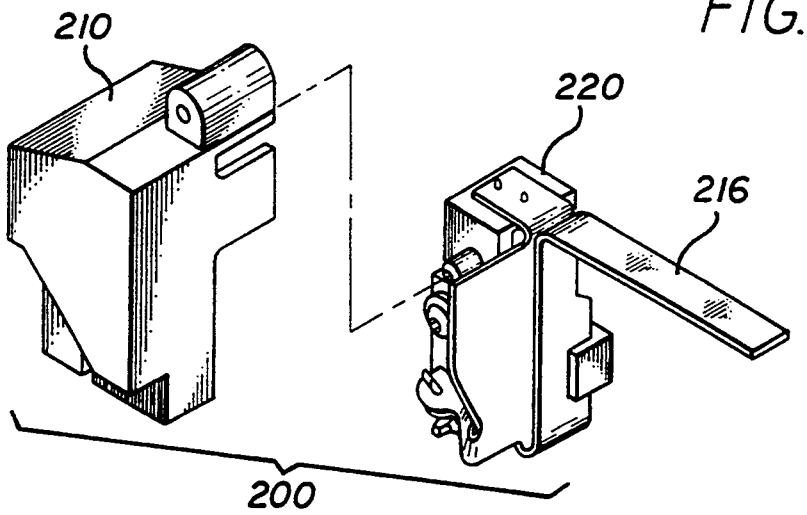
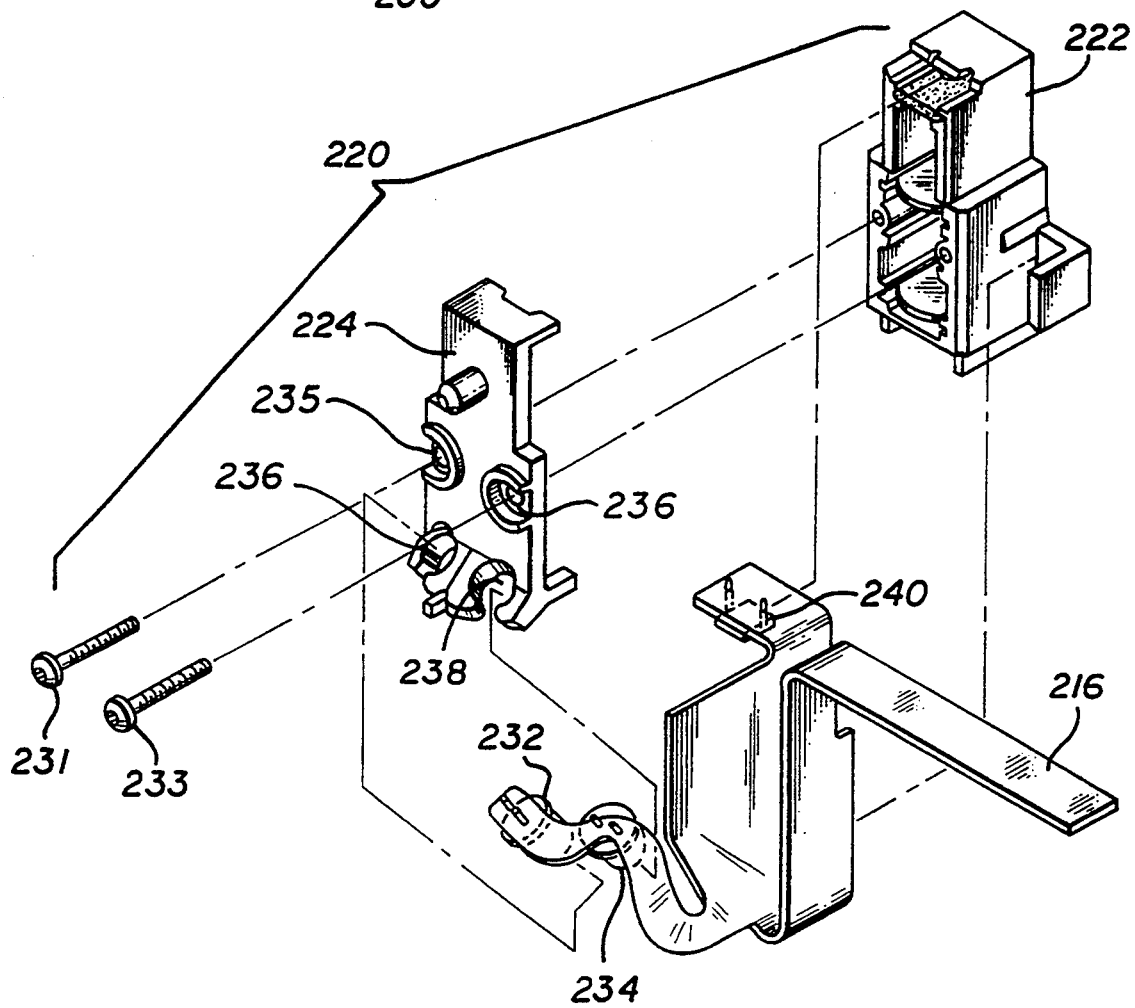
FIG. 6d

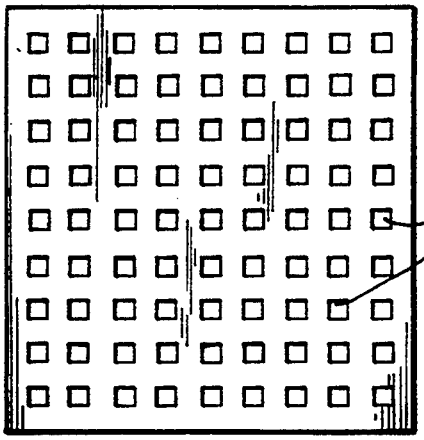
FIG. 8a
FIG. 8b
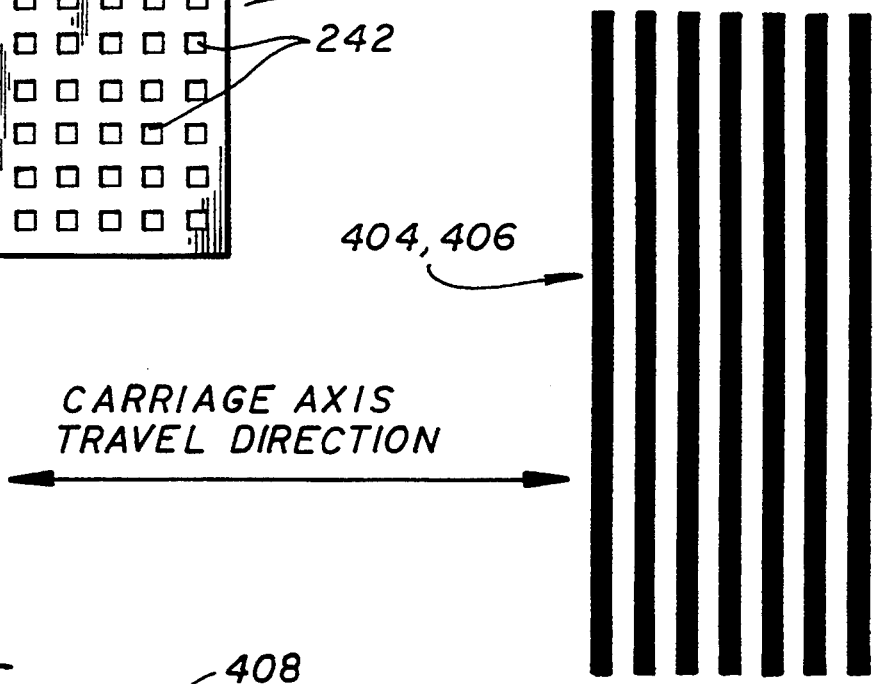
FIG. 8c
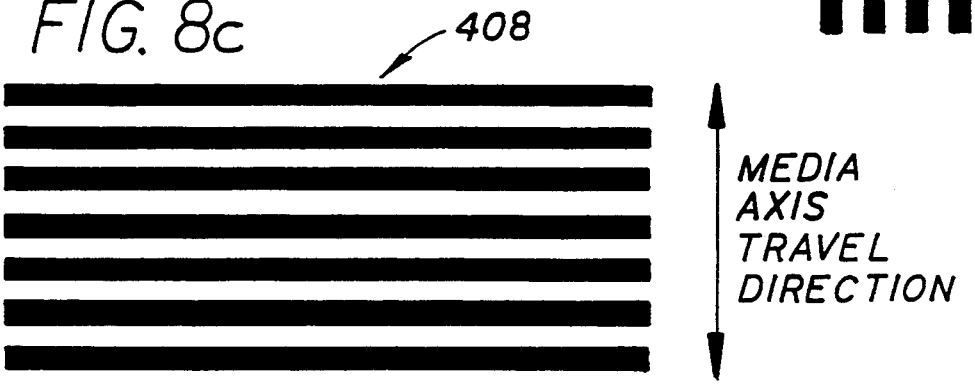
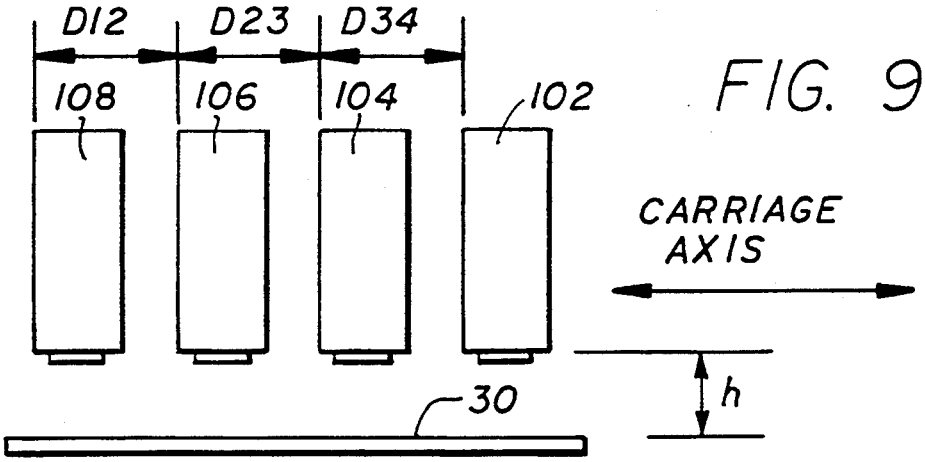
FIG. 9

REFERENCE PATTERN FOR USE IN ALIGNING MULTIPLE INKJET CARTRIDGES

BACKGROUND OF THE INVENTION

1. Field of the Invention

The present invention relates to printers and plotters. More specifically, the present invention relates to inkjet printers and plotters having multiple pens for multicolor operation.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art:

Inkjet printer/plotters, such as those sold by Hewlett Packard Company, offer substantial improvements in speed over the conventional X–Y plotter. Inkjet printer/plotters typically include a pen having an array of nozzles. The pens are mounted on a carriage which is moved across the page in successive swaths. Each inkjet pen has heater circuits which, when activated, cause ink to be ejected from associated nozzles. As the pen is positioned over a given location, a jet of ink is ejected from the nozzle to provide a pixel of ink at a desired location. The mosaic of pixels thus created provides a desired composite image.

Inkjet technology is now well known in the art. See, for example, U.S. Pat. Nos. 4,872,027, entitled PRINTER HAVING IDENTIFIABLE INTERCHANGEABLE HEADS, issued Oct. 3, 1989, to W. A. Buskirk et al. and 4,965,593, entitled PRINT QUALITY OF DOT PRINTERS, issued Oct. 23, 1990, to M. S. Hickman, the teachings of which are incorporated herein by reference.

Recently, full color inkjet printer/plotters have been developed which comprise a plurality of inkjet pens of diverse colors. A typical color inkjet printer/plotter has four inkjet pens, one that stores black ink, and three that store colored inks, e.g., magenta, cyan and yellow. The colors from the three color pens are mixed to obtain any particular color.

The pens are typically mounted in stalls within an assembly which is mounted on the carriage of the printer/plotter. The carriage assembly positions the inkjet pens and typically holds the circuitry required for interface to the heater circuits in the inkjet pens.

Full color printing and plotting requires that the colors from the individual pens be precisely applied to the media. This requires precise alignment of the carriage assembly. Unfortunately, mechanical misalignment of the pens in conventional inkjet printer/plotters results in offsets in the x direction (in the media or paper axis) and in the y direction (in the scan or carriage axis). This misalignment of the carriage assembly manifests as a misregistration of the print images applied by the individual pens. In addition, other misalignments may arise due to the speed of the carriage, the curvature of the platen and/or spray from the nozzles.

One conventional approach for aligning the pens involves the use of optical drop detectors. This technique is described and claimed in U.S. Pat. No. 4,922,270, issued May 1, 1990, to Cobbs et al. and entitled Inter Pen Offset Determination and Compensation in Multi-Pen Thermal Ink Jet Printing Systems, the teachings of which are incorporated herein by reference. The optical drop detectors detect the position of each ink drop as it leaves the pen. The system then calculates the point of impact of the drop on the print media. Unfortunately, the actual impact point often differs substantially from the calculated impact point due to angularity. Angularity results from the movement of the pen in the scan axis as ink is being ejected. That is, there is a delay between the time that the drop of ink is ejected and the time that the drop impacts the media. This flight time delay causes the drop to traverse an angular path toward the media. If not accurately calculated and corrected, this would cause a distortion in the print image. However, inasmuch as accurate calculation and correction has heretofore been difficult to achieve, this technique has been found to be inadequate for current product specifications for full color printing.

In another conventional approach, a test pattern is printed and the print image is sensed optically to determine the degree of image misregistration. This technique is disclosed and claimed in copending U.S. patent application Ser. No. 07/786,145, entitled Automatic Print Cartridge Alignment Sensor System, filed Oct. 31, 1991 by Robert D. Haselby (the teachings of which are incorporated herein by reference). However, this system is slow in that it required a self-calibration reference pattern for aligning the sensor.

Thus, there is a need in the art for systems and techniques for providing accurate image registration in multicolor, multi-pen inkjet printer/plotters.

SUMMARY OF THE INVENTION

The need in the art is addressed by the present invention which provides a test pattern for use with an optical sensor for an inkjet printer. The inventive pattern comprises a first plurality of vertical bars horizontally spaced and a second plurality of horizontal bars vertically spaced. The spacing between the bars is approximately equal to the width of the bars.

In a particular implementation, the pattern is adapted for use with an inkjet printer having a plurality of pens. The first plurality of bars includes a first set of bars printed by each of the pens. The first plurality of bars includes a second set of bars printed by one of the pens moving at at least two different horizontal speeds. The second plurality of bars includes one column of vertically spaced bars for each of the pens. Each column of vertically spaced bars includes a first plurality of vertically spaced bars printed by a first pen. A respective column of vertically spaced bars includes a second plurality of vertically spaced bars printed by a respective one of the pens. Each column of vertically spaced bars includes a third plurality of vertically spaced bars printed by the first pen.

The inventive pattern allows for considerable information with respect to pen alignments to be determined by optical scanning.

BRIEF DESCRIPTION OF THE DRAWINGS

FIG. 3 is perspective view of a simplified representation of a media positioning system utilized in the inventive printer.

FIG. 6*a* is a right-front perspective view of the sensor module utilized in the system of the present invention.

FIG. 6*b* is a right-rear perspective view of the sensor module utilized in the system of the present invention.

FIG. 6*c* shows a right-rear perspective view of the sensor module partially disassembled to reveal an outer housing and an inner assembly.

FIG. 6*d* is a right-rear perspective view of the inner assembly of the sensor module of the present invention partially disassembled.

FIG. 8*a* is a top view of the phase plate of the sensor module of the present invention.

FIG. 8*b* is illustrative of the carriage axis patterns of the test pattern utilized in alignment system of the present invention.

FIG. 8*c* is illustrative of the media axis patterns of the test pattern utilized in alignment system of the present invention.

FIG. 9 shows a frontal representation of first, second, third and fourth inkjet cartridges positioned over media for movement along the carriage scan axis.

DESCRIPTION OF THE INVENTION

Illustrative embodiments and exemplary applications will now be described with reference to the accompanying drawings to disclose the advantageous teachings of the present invention.

Figure 1:
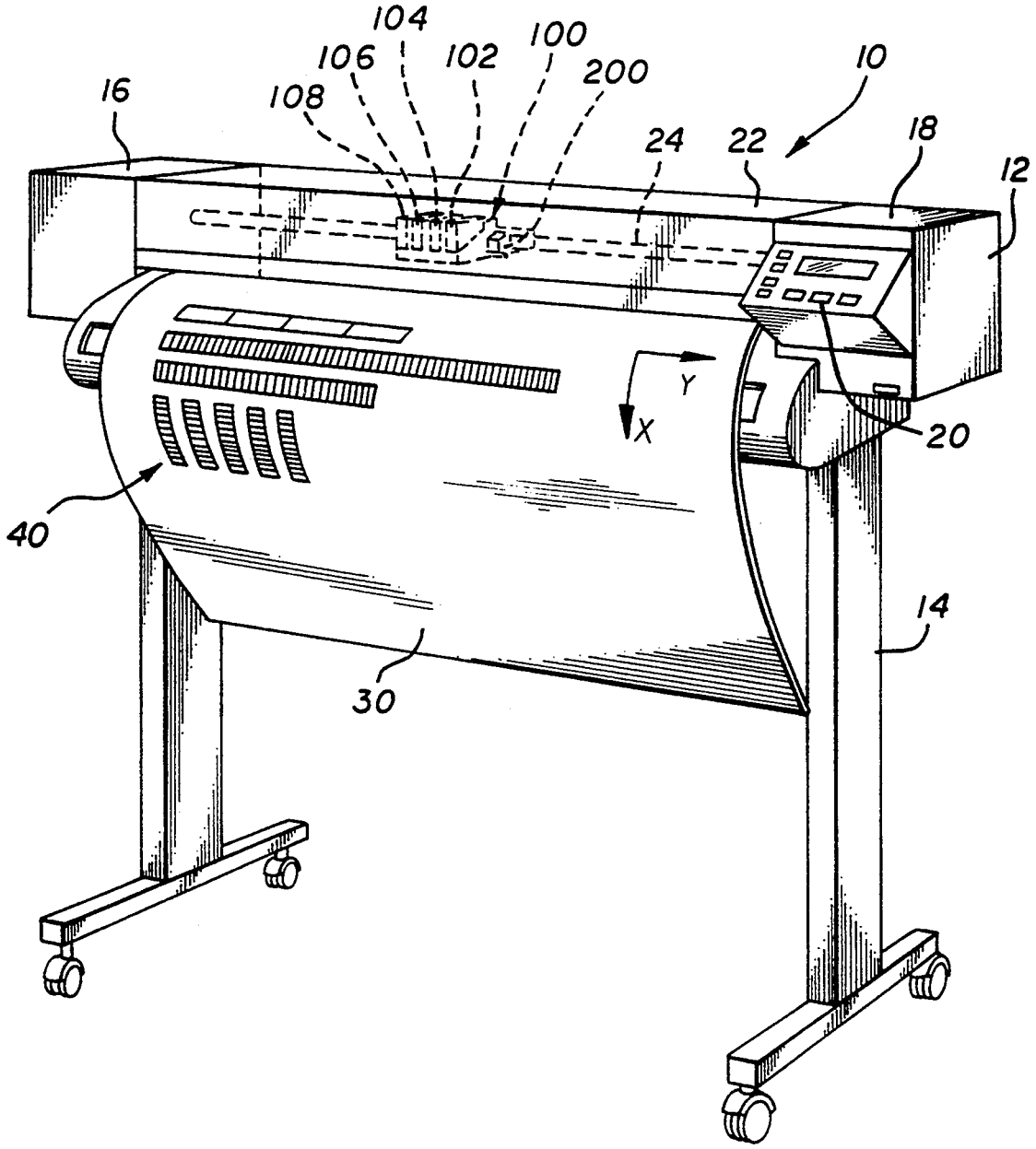
FIG. 1 is a perspective view of a thermal inkjet large format printer/plotter incorporating the teachings of the present invention.

FIG. 1 is a perspective view of a thermal inkjet large format printer/plotter incorporating the teachings of the present invention. The printer 10 includes a housing 12 mounted on a stand 14. The housing has left and right drive mechanism enclosures 16 and 18. A control panel 20 is mounted on the right enclosure 18. A carriage assembly 100, illustrated in phantom under a transparent cover 22, is adapted for reciprocal motion along a carriage bar 24, also shown in phantom. The position of the carriage assembly 100 in a horizontal or carriage scan axis is determined by a carriage positioning mechanism 110 (not shown) with respect to an encoder strip 120 (not shown) as discussed more fully below. A print medium 30 such as paper is positioned along a vertical or media axis by a media axis drive mechanism (not shown). As is common in the art, the media axis is denoted as the 'x' axis and the scan axis is denoted as the 'y' axis.

Figure 2:
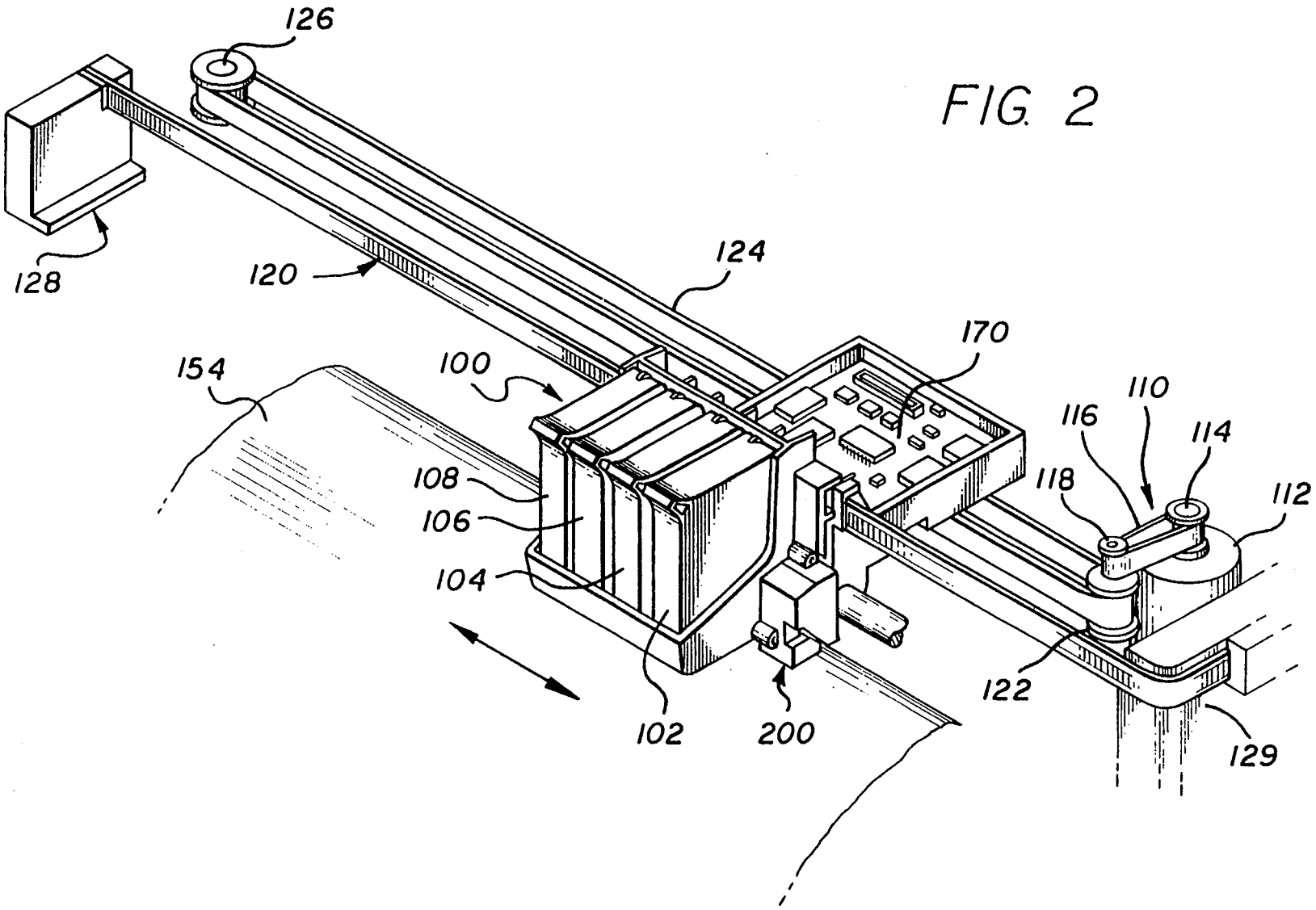
FIG. 2 is a perspective view of the carriage assembly, the carriage positioning mechanism, and the paper positioning mechanism of the inventive printer/plotter.

FIG. 2 is a perspective view of the carriage assembly 100, the carriage positioning mechanism 110 and the encoder strip 120. The carriage positioning mechanism 110 includes a carriage position motor 112 which has a shaft 114 extending therefrom through which the motor drives a small belt 116. Through the small belt 116, the carriage position motor 112 drives an idler 122 via the shaft 118 thereof. In turn, the idler 122 drives a belt 124 which is secured by a second idler 126. The belt 124 is attached to the carriage 100 and adapted to slide therethrough.

The position of the carriage assembly in the scan axis is determined precisely by the use of the code strip 120. The code strip 120 is secured by a first stanchion 128 on one end and a second stanchion 129 on the other end. The code strip 120 may be implemented in the manner disclosed and claimed in a copending application entitled Improved Code strip in a Large-Format Image-Related Device, Ser. No. 07/785,376, filed Oct. 30, 1991, by Wilcox et al., the teachings of which are incorporated herein by reference. As disclosed in the reference, an optical reader (not shown) is disposed on the carriage assembly and provides carriage position signals which are utilized by the invention to achieve optimal image registration in the manner described below.

FIG. 3 is a perspective view of a simplified representation of a media positioning system 150 utilized in the inventive printer. The media positioning system 150 includes a motor 152 which is coaxial with a media roller 154. The position of the media roller 154 is determined by a media position encoder 156. The media position encoder includes a disc 158 having a plurality of apertures 159 therein. An optical reader 160 provides a plurality of output pulses which facilitate the determination of the roller 154 and, therefore, the position of the media 30 as well. Position encoders are well known in the art. See for example, Economical, High-Performance Optical Encoders by Howard C. Epstein et al, published in the Hewlett Packard Journal, October 1988, pages 99–106.

The media and carriage position information is provided to a processor on a circuit board 170 disposed on the carriage assembly 100 (FIG. 2) for use in connection with pen alignment techniques of the present invention. (The terms pen and cartridge are used interchangeably herein as is common in the art.)

Returning to FIG. 1, the printer 10 has four inkjet pens, 102, 104, 106, and 108 that store ink of different colors, e.g., black, yellow, magenta and cyan ink, respectively. As the carriage assembly 100 translates relative to the medium 30 along the x and y axes, selected nozzles in the thermal inkjet cartridge pens 102, 104, 106, and 108 are activated and ink is applied to the medium 30. The colors from the three color inkjet pens are mixed to obtain any other particular color.

Figure 4:
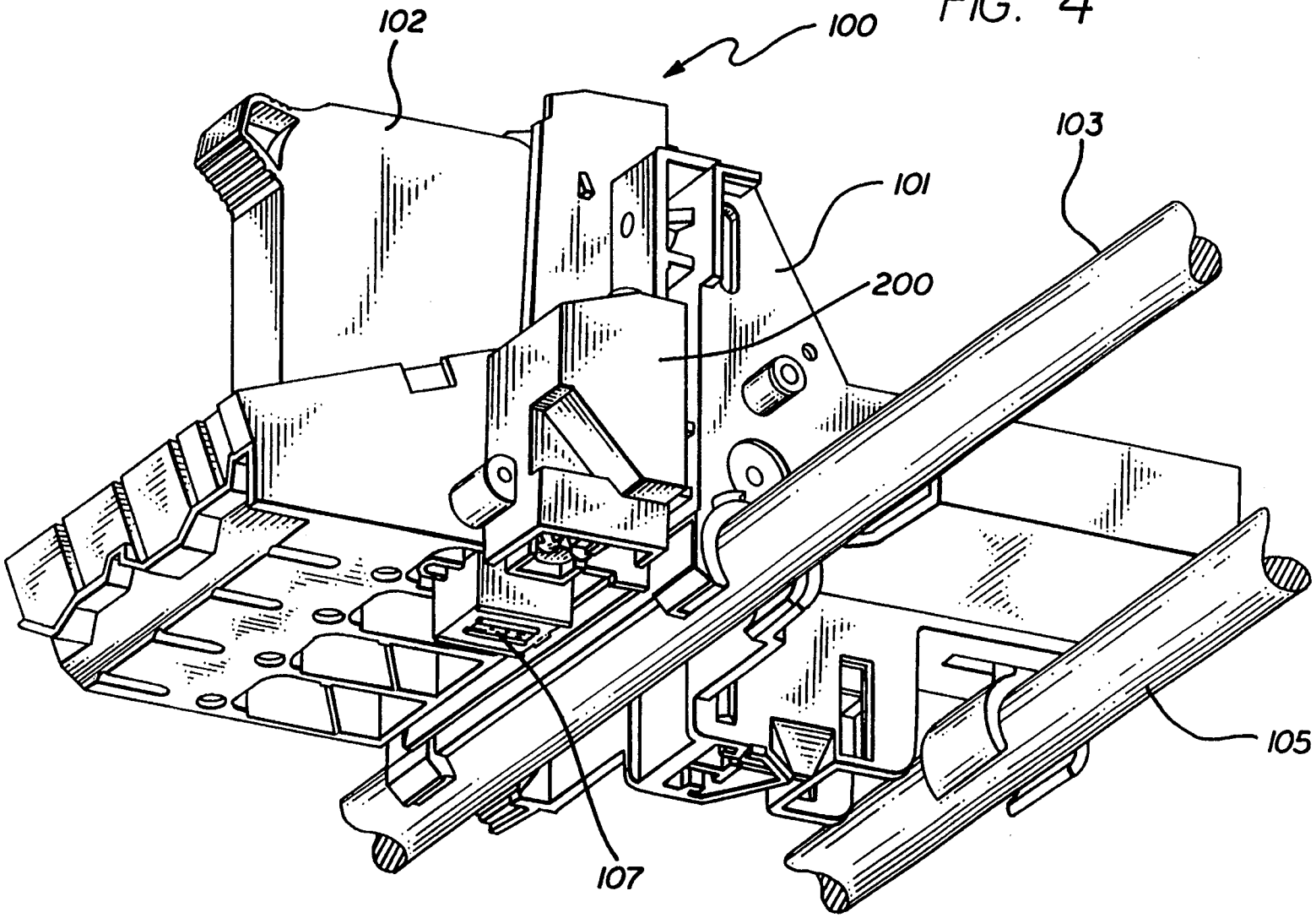
FIG. 4 is a right-bottom perspective view of the carriage assembly of the present invention showing the sensor module.

FIG. 4 is a right-bottom perspective view of the carriage assembly 100 of the present invention showing the sensor module 200. The carriage assembly 100 positions the inkjet pens and holds the circuitry required for interface to the heater circuits in the inkjet pens. The carriage assembly 100 includes a carriage 101 adapted for reciprocal motion on a front slider 103 and a rear slider 105. A first pen cartridge 102 is mounted in a first stall of the carriage 101. Note that the ink jet nozzles 107 of each pen are in line with the sensor module 200.

As mentioned above, full color printing and plotting requires that the colors from the individual pens be precisely applied to the media. This requires precise alignment of the carriage assembly. Unfortunately, paper slippage, paper skew, and mechanical misalignment of the pens in conventional inkjet printer/plotters results in offsets in the x direction (in the media or paper axis) and in the y direction (in the scan or carriage axis). This misalignment of the carriage assembly manifests as a misregistration of the print images applied by the individual pens. This is generally unacceptable as multicolor printing requires image registration accuracy from each cartridge to within 1 one-thousandth of an inch or 1 mil.

In accordance with the present teachings and as discussed more fully below, a test pattern 40 is generated whenever any of the cartridges are disturbed by activation of selected nozzles in selected pens. The test pattern is depicted in the magnified view of FIG. 5. The manner by which the test pattern 40 is generated and utilized to effect accurate image registration is discussed more fully below.

As depicted most clearly in FIG. 2, an optical sensor module 200 is mounted on the carriage assembly 200. Optical sensors are known in the art. See for example, U.S. Pat. No. 5,170,047 entitled Optical Sensor for Plotter Pen Verification, issued Dec. 8, 1992 to Beauchamp et al., the teachings of which are incorporated herein by reference.

The sensor module 200 optically senses the test pattern and provides electrical signals to the processor on the circuit board 170 indicative of the registration of the images thereon.

FIG. 6*a* is a right-front perspective view of the sensor module 200 utilized in the system of the present invention. The sensor module 200 includes an outer housing 210 with two protrusions 212 and 214 adapted to receive first and second mounting screws. The outer housing 210 provides electrostatic discharge (ESD) protection for the module 200.

FIG. 6*b* is a right-rear perspective view of the sensor module 200.

FIG. 6*c* shows a right-rear perspective view of the sensor module partially disassembled to reveal the outer housing 210 and an inner assembly 220. The inner assembly 220 is adapted to be retained within the outer housing 210. A flexible circuit 216 is disposed on the inner housing 220. The flexible circuit 216 includes an amplifier and contacts for interfacing the sensor module to the processor circuit as discussed more fully below.

FIG. 6*d* is a right-rear perspective view of the inner assembly 220 of the sensor module 200 of the present invention partially disassembled. As illustrated in FIG. 6*d*, the inner assembly includes an optical component holder 222 and a cover 224.

Figure 6E:
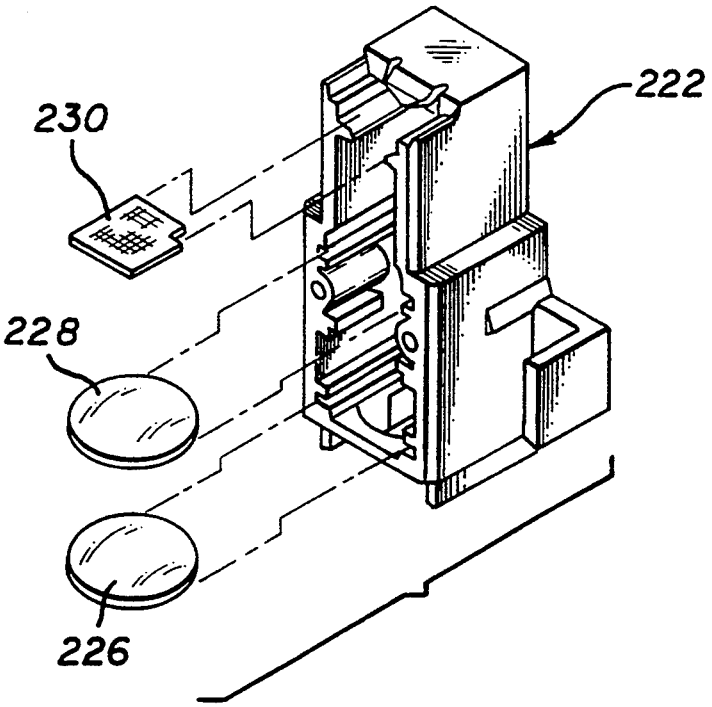
FIG. 6*e* is a right-rear perspective view of the optical component holder of the sensor module of the present invention disassembled.

FIG. 6*e* is a right-rear perspective view of the optical component holder of the sensor module of the present invention disassembled. As illustrated in FIG. 6*e*, the optical component holder 222 is adapted to hold first and second lenses 226 and 228 in a fixed position relative to a phase plate 230. Returning to FIG. 6*d*, first and second light emitting diodes (LEDs) 232 and 234 are mounted on the flexible circuit 240 along with a photodetector 240 and amplifier and other circuit elements (not shown). The light emitting diodes and the photodetector are of conventional design and have a bandwidth which encompasses the frequencies of the colors of the inks provided by the pens 102–108 (even numbers only). The LEDs 232 and 234 are retained at an angle by first and second apertures 236 and 238, respectively, in the cover 224 of the holder 222. The cover 224 is secured to the holder 222 by first and second screws 231 and 233 which extend through first and second apertures 235 and 236, respectively, in the cover 224 and which are received by threads (not shown) in the holder 222.

Figure 7:
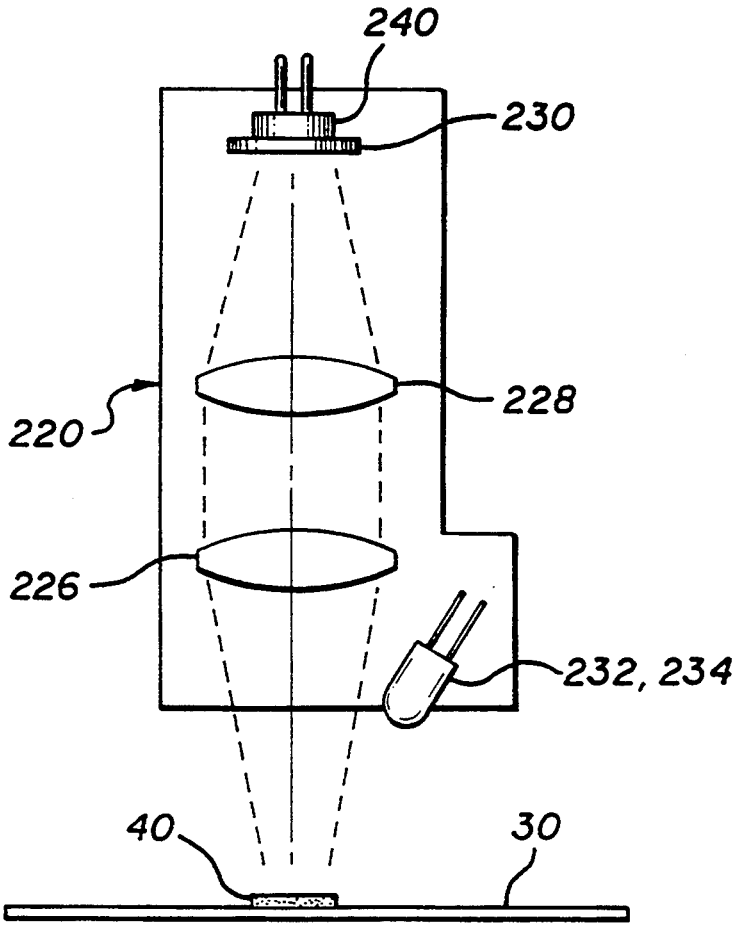
FIG. 7 is a schematic diagram of the optical components of the sensor module of the present invention.

The functional relationships of the components of the sensor module are illustrated in the schematic diagram of FIG. 7. Light energy from the LEDs 232 and 234 impinges upon the test pattern 40 on the media 30 and is reflected to the photodetector 240 via the first and second lenses 226 and 228, respectively, and the phase plate 230. The lenses 226 and 228 focus energy on photodetector 240 via the phase plate 230. The phase plate 230 is a symmetrical grating constructed of plastic or other suitably opaque material.

Figure 5:
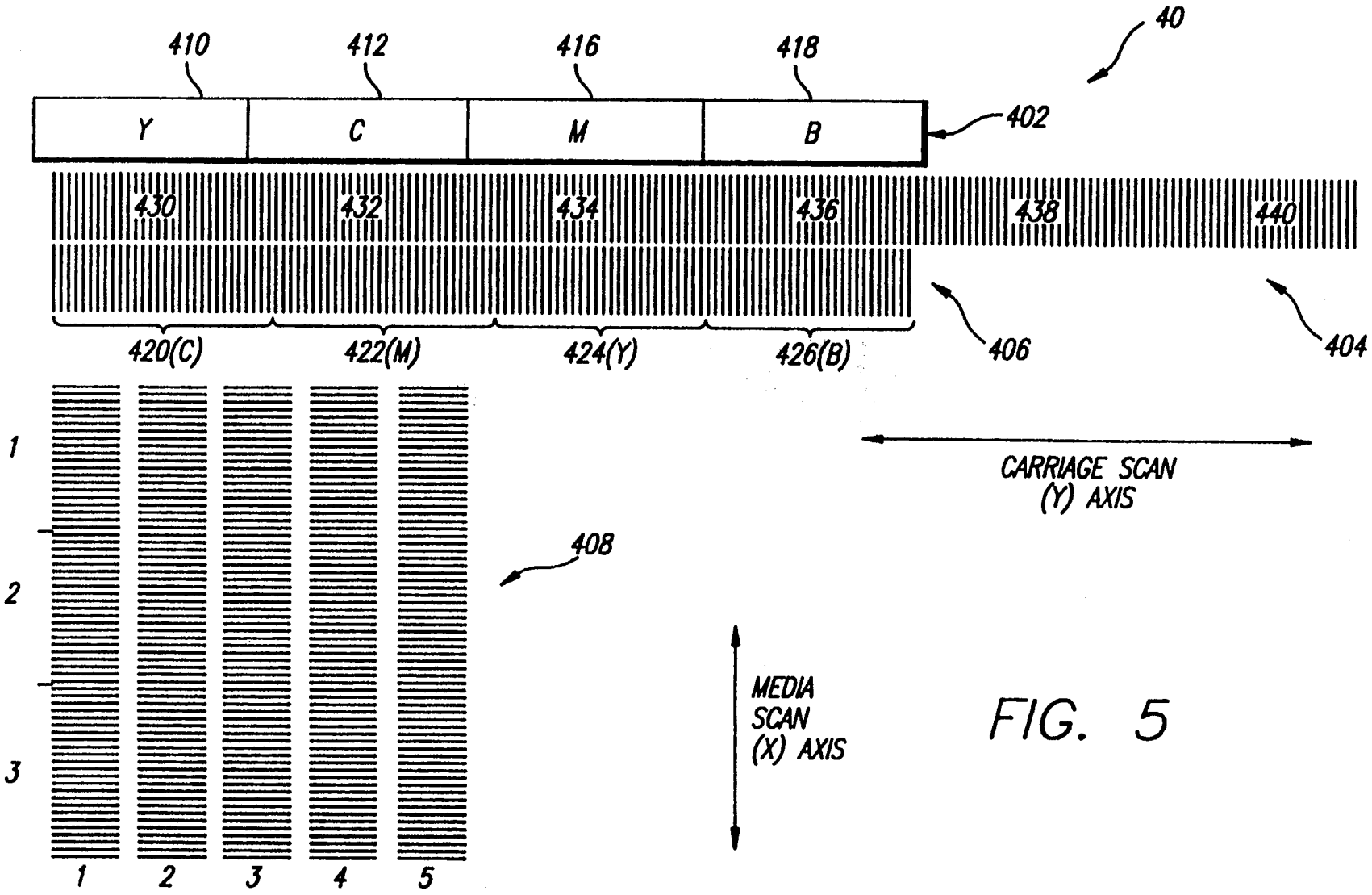
FIG. 5 is a magnified view of the test pattern utilized to effect pen alignment in accordance with the present teachings.

FIG. 8*a* is a top view of the phase plate 230. A symmetrical array of transparent openings 242 are provided in the opaque material. In accordance with the present teachings, as illustrated in FIG. 8*b*, the line widths in the test pattern 40 for the carriage axis patterns 404 and 406 of FIG. 5 are equal to the horizontal spacings between the transparent openings 242 in the phase plate 230. Likewise, as illustrated in FIG. 8*c*, the line widths in the test pattern 40 in the media axis patterns 408 of FIG. 5 are equal to the vertical spacings between the transparent openings 242 in the phase plate 230. The use of the phase plate 230 permits a simple, inexpensive optical arrangement to be used to quickly scan the pattern in each direction of movement.

As the sensor module 200 scans the test pattern 40 in either the carriage scan axis or the media scan axis, an output signal is provided which varies as a sine wave. As discussed more fully below, the circuitry of the present invention stores these signals and examines the phase relationships thereof to determine the alignment of the pens for each direction of movement. The alignment procedure of the present invention by which the system corrects for carriage axis misalignment, paper axis misalignment and offsets due to speed and curvature will now be disclosed.

As a first step in the alignment procedure, the test pattern 40 of FIG. 5 is generated. The first pattern 402 is generated in the scan axis for the purpose of exercising the pens 102–108 (even numbers only). The first pattern 402 includes one segment for each cartridge utilized. For example, the first segment 410 is yellow, the second segment 412 is cyan, the third segment 416 is magenta and the fourth segment 418 is black.

Next, the second, third and fourth patterns 404, 406 and 408, respectively, are generated. The second pattern 404 is used to test for pen offsets due to speed and curvature. The third pattern 406 is used to test for misalignments in the carriage scan axis. The fourth patterns 408 are used to test for misalignments in the media axis. The invention is best understood with reference to the carriage and media scan axis alignment techniques thereof.

Correction for Pen Offsets in the Carriage (Scan) Axis

The carriage scan axis alignment pattern 406 is generated by causing each pen to print a plurality of horizontally spaced vertical bars. As mentioned above, the thickness of the bars is equal to the spacing therebetween which is also equal to the width of the transparent openings in the phase plate 230 and the spacings therebetween. In the third pattern 406 the first segment 420 is cyan, the second segment 422 is magenta, the third segment 424 is yellow and the fourth segment 426 is black.

Pen misalignments in the carriage scan axis are illustrated in FIG. 9 which shows a frontal representation of the first, second, third and fourth inkjet cartridges 102, 104, 106 and 108 positioned a height 'h' over the media 30 for movement along the carriage scan axis. As is known in the art, the distances D12, D23, and D34 between the cartridges vary because of the mechanical tolerances and imperfections in the manufacturing of the device. This results in undesired displacements in the placement of the ink drops of one cartridge with respect to another cartridge.

Pen misalignments in the carriage scan axis are corrected by scanning the third pattern 406 along the carriage scan axis with the sensor module 200. As the sensor module 200 illuminates the third pattern 406, the lenses 226 and 228 thereof (FIG. 6*e*) focus an image on the phase plate 230 and the photodetector 240. In response, the photodetector 240 generates a sinusoidal output signal which is the mathematical convolution of the phase plate pattern and the test pattern 406.

Figure 10:
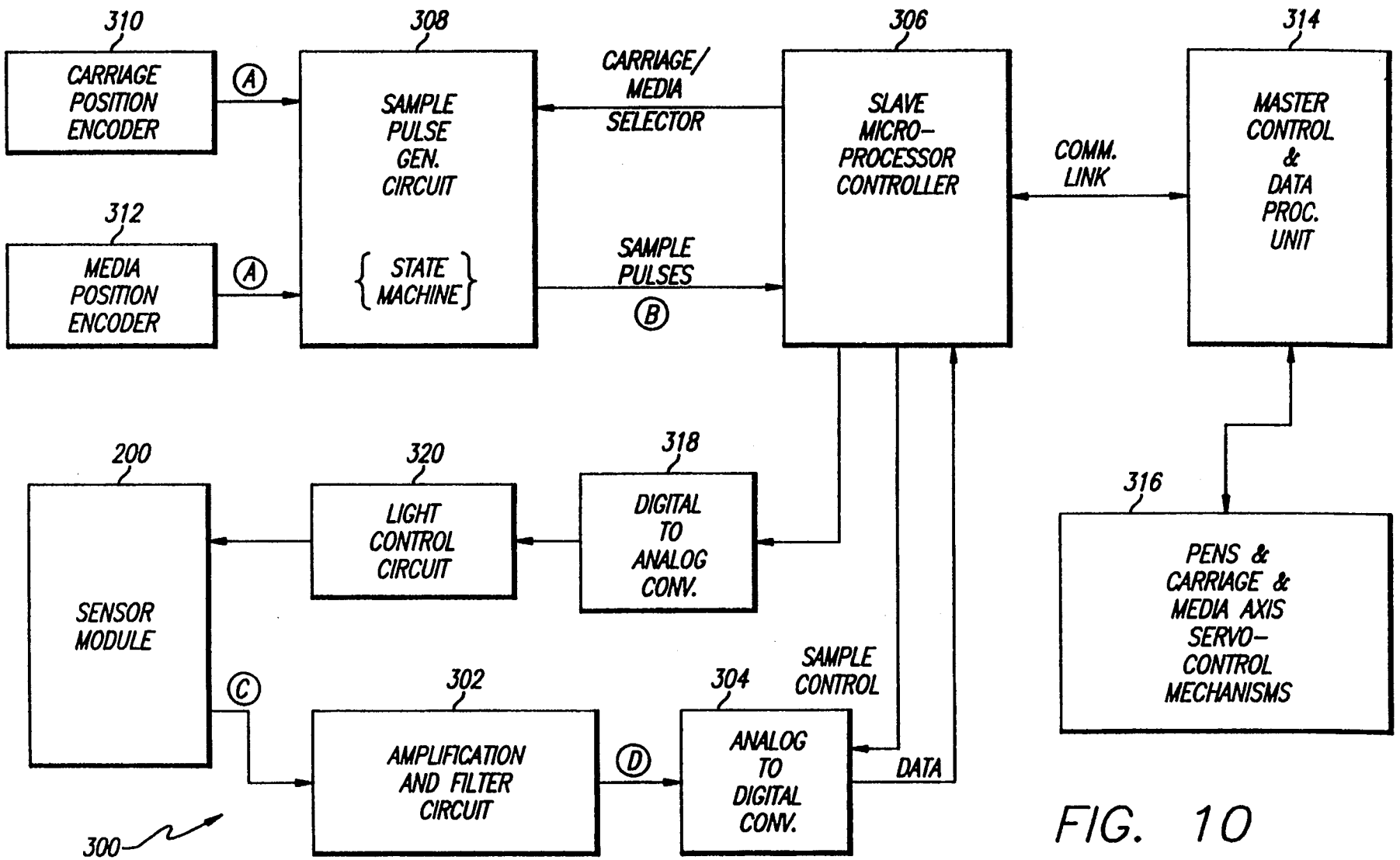
FIG. 10 is a block diagram of the electronic circuit utilized in the alignment system of the present invention.

FIG. 10 is a block diagram of the electronic circuit 300 utilized in the alignment system of the present invention. The circuit 300 includes an amplification and filtering circuit 302, an analog to digital converter 304, a slave microprocessor controller 306, a sample pulse generator circuit 308, a carriage position encoder 310, a media position encoder 312, a master control and data processing unit 314, a carriage and media axis servo-control mechanism 316, a digital to analog converter 318 and a light control circuit 320. The electrical signals from the sensor module 200 are amplified, filtered and sampled by the slave microprocessor 306. The carriage position encoder 310 provides sample pulses as the carriage assembly 100 moves along the encoder strip 120 of FIGS. 1 and 2. A sample pulse generator circuit 308 selects pulses from the carriage position encoder 310 or the media position encoder 312 depending on the test being performed.

Figure 11:
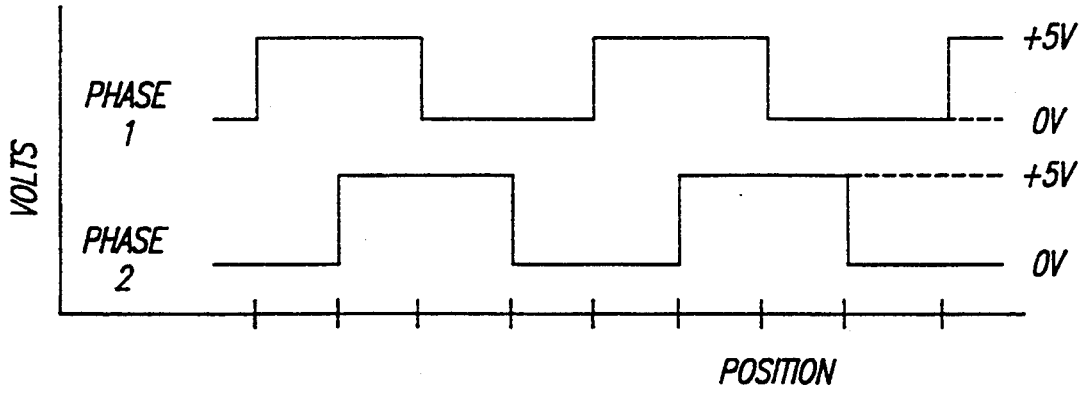
FIG. 11 is a graph illustrative of the outputs of the carriage and media position encoders.

FIG. 11 is a graph illustrative of the quadrature outputs of the carriage and media position encoders.

Figure 12:
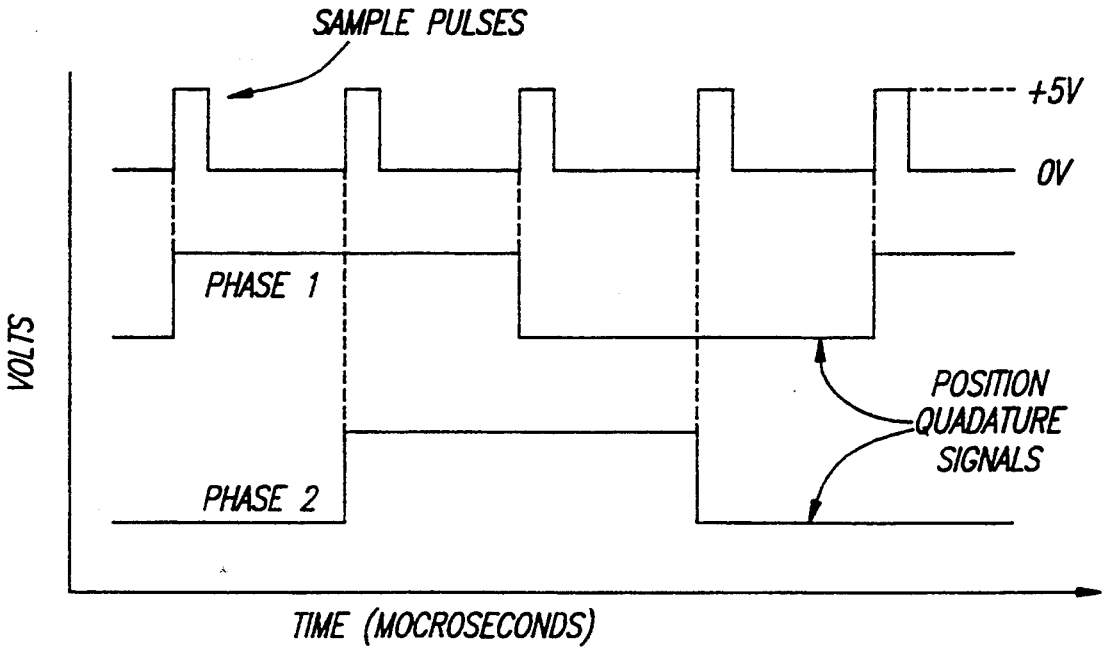
FIG. 12 illustrates the sample pulses generated by the sample pulse generator circuit of the present invention.

FIG. 12 illustrates the sample pulses generated by the sample pulse generator circuit 308. The slave microprocessor 306 uses the sample pulses to generate sample control signals for the analog-to-digital converter 304. On receipt of a sample control pulse, the analog-to-digital converter 304 samples the output of the amplification and filter circuit 302.

Figure 13:
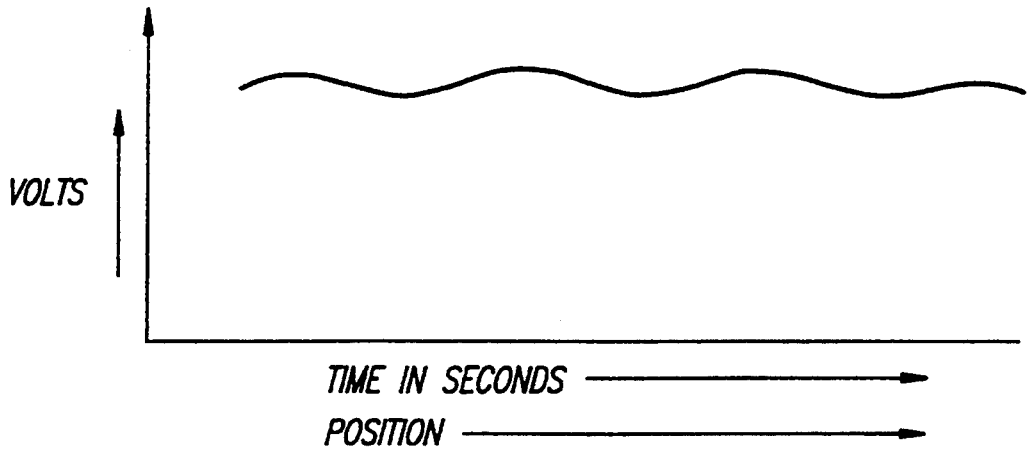
FIG. 13 illustrates the output of the sensor module of the present invention.
Figure 14:
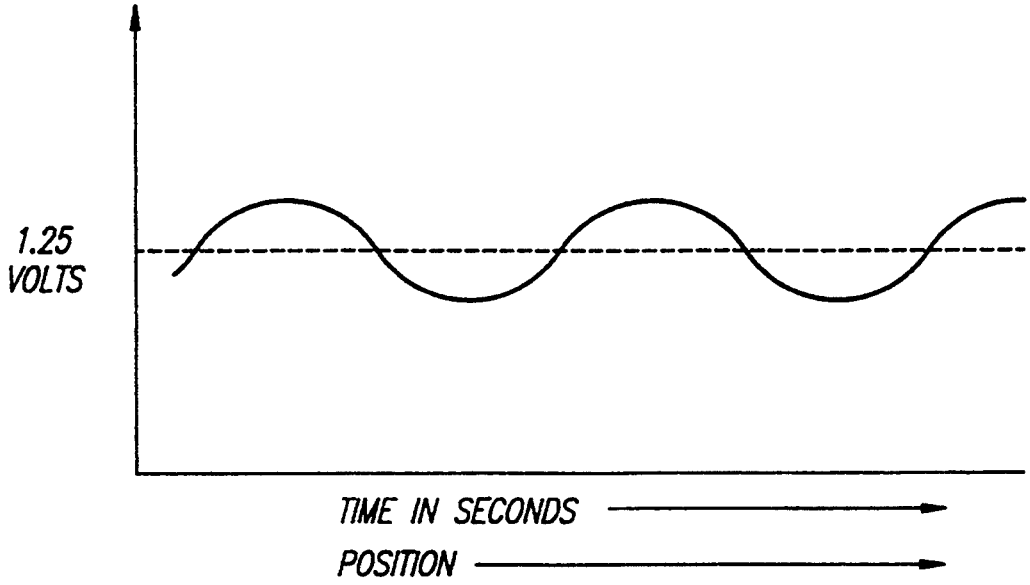
FIG. 14 shows how the output of the sensor module of the present invention appears after amplification and filtering.
Figure 15:
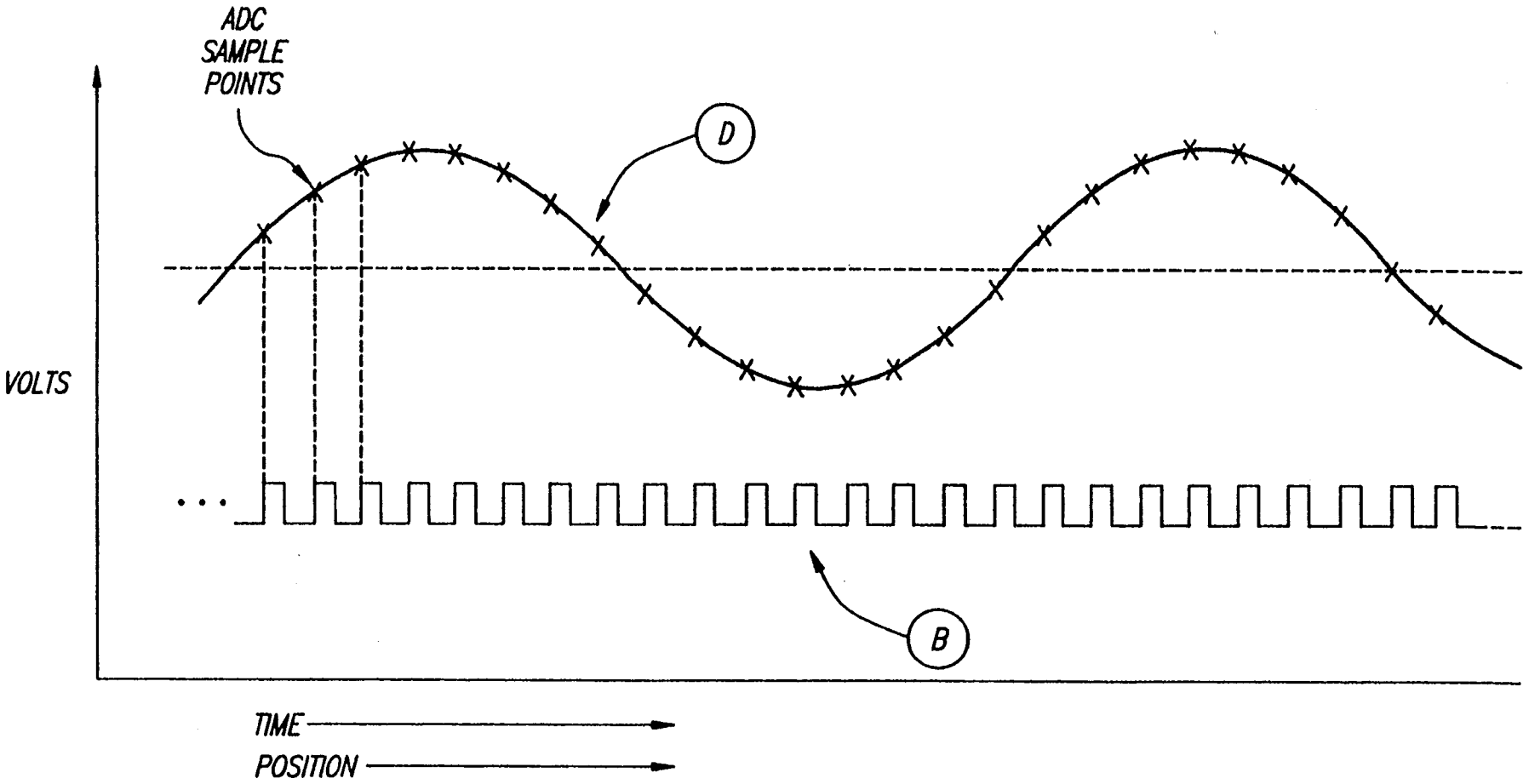
FIG. 15 is a graph which illustrates how the output of the amplification and filtering circuit is sampled to provide data which is input to the slave microprocessor controller of the invention.

This is illustrated in FIGS. 13, 14 and 15. The output of the sensor module 200 is illustrated in FIG. 13. FIG. 14 shows how the output of the sensor module 200 appears after amplification and filtering. FIG. 15 is a graph which illustrates how the output of the amplification and filtering circuit 302 is sampled to provide data which is input to the slave microprocessor controller 306. The digitized samples are stored in memory for each direction of movement in the slave microprocessor controller 306. The master control and data processing unit 314 mathematically fits a reference sine wave to the sample points stored in memory, using a least squares fit algorithm or other suitable conventional algorithm, and computes a phase difference between the reference sine wave and the sensed sine wave. The location of the phase difference provides an indication as to which cartridge is out of alignment. The polarity of the phase difference indicates the direction of misalignment and the magnitude of the phase difference indicates the magnitude of the misalignment. Offsets for each cartridge are generated by the master control and data processing unit which are stored in the machine. These offsets are used to control activation of the pens as the assembly is scanned in the carriage axis via the servo mechanisms 316. Sensor module light activation is provided by the slave microprocessor controller 306, a digital-to-analog converter 318 and a light control circuit 320.

Correction of Offsets Due to Speed and Curvature

Other corrections which must be made in the carriage scan axis are for 1) image misplacement due to the velocity of the carriage and 2) image displacements due to curvature of the platen.

Figure 16:
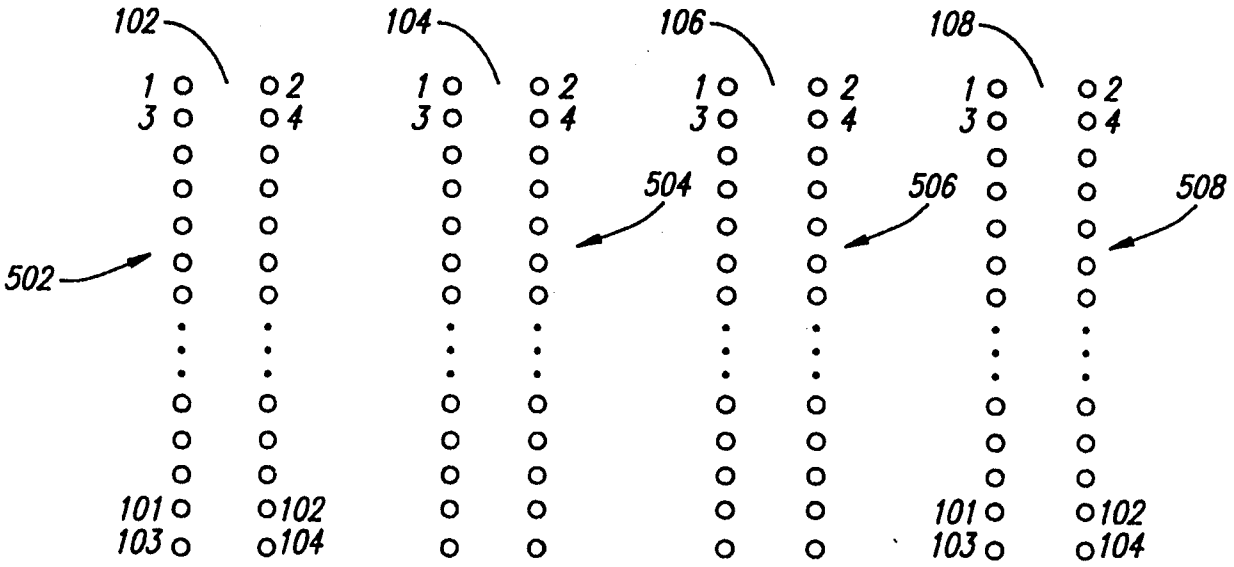
FIG. 16 is a magnified bottom view of the thermal inkjet nozzles of each of the pen cartridges.

FIG. 16 is a magnified bottom view of the thermal inkjet nozzles of each of the pen cartridges 102, 104, 106 and 108, respectively. Typically, only 96 of the 104 nozzles (e.g., nozzles numbered 5–100) are used for printing. The remaining eight nozzles are used for offset adjustment as discussed more fully below.

Figure 17:
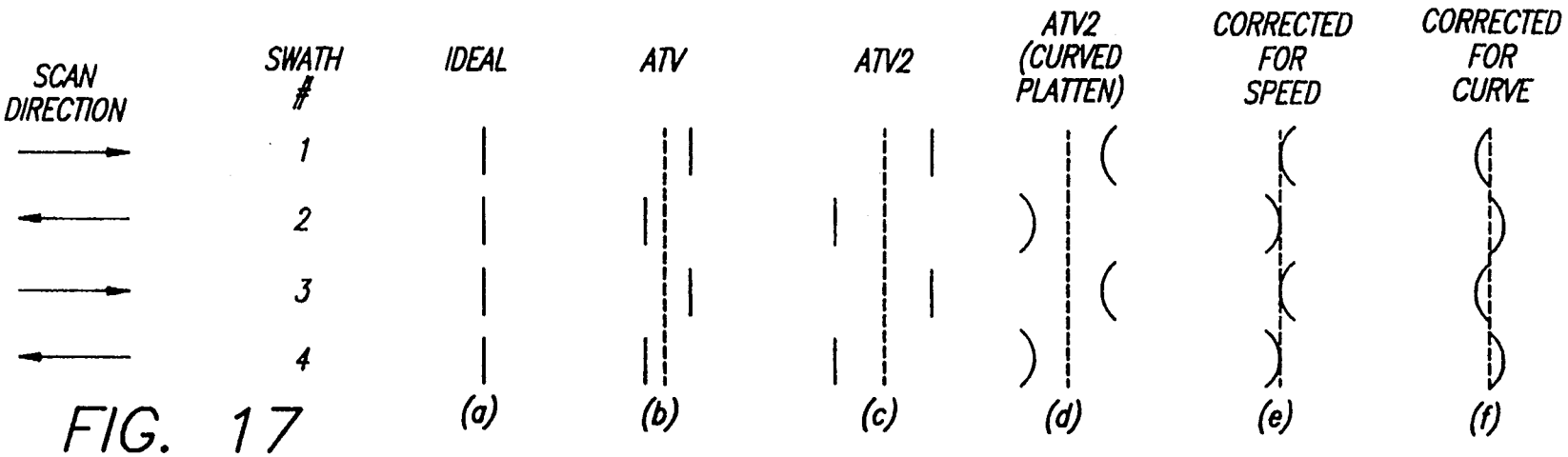
FIG. 17 shows offsets due to speed and the effect of platen curvature for a print image.

As the printheads move in forward and reverse directions at a height h above the media 30, as depicted in FIG. 9, the images created by the nozzles deviate from ideal as shown in FIG. 17. FIG. 17 shows offsets due to speed and the effect of platen curvature for a print image. At a higher speed $V_2$, a greater offset from ideal results.

Figure 18:
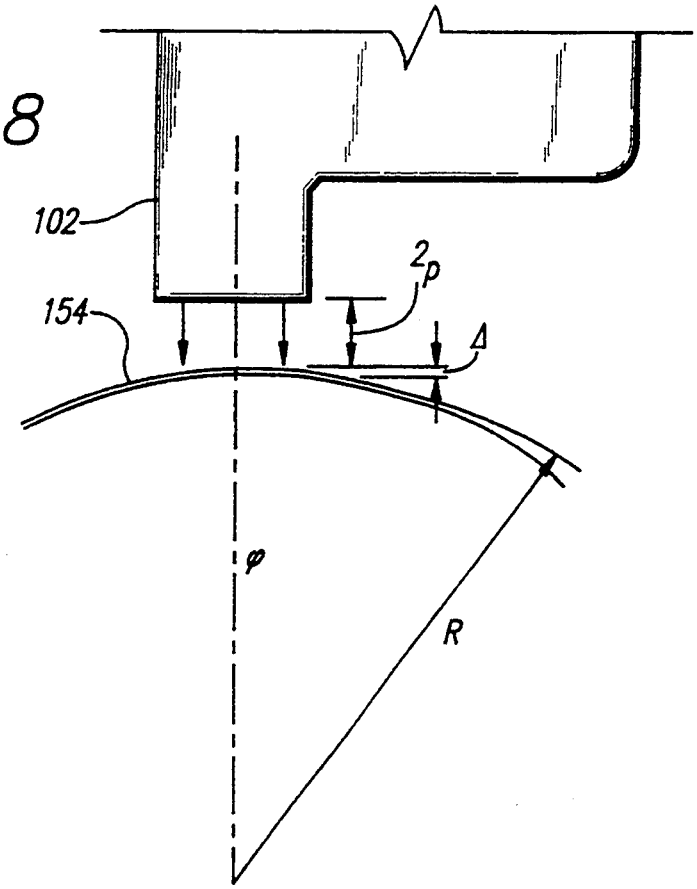
FIG. 18 is a magnified side view of a nozzle above a curved platen.

When the media is supported by a curved platen, such as that shown at 154 in FIG. 3, a height differential $\Delta$, as illustrated in FIG. 18, exists. FIG. 18 is a magnified side view of a nozzle 102 above a curved platen 154. The variation in height due to curvature of the platen increases the delay time for the ink to reach the media. This manifests as curvature in the line as illustrated at (d) in FIG. 17 where the dashed line represents the ideal image shape and location.

The present invention corrects for offsets due to speed and curvature as discussed below. Offsets due to speed are corrected first by printing images from a single cartridge (e.g., the black cartridge 102) at three different speeds in each direction. This is illustrated at 430–440 (even numbers only) in the bidirectional pattern 404 of the test pattern 40 of FIG. 5. The bidirectional pattern 404 is generated by causing each pen to print a plurality of horizontally spaced vertical bars. As mentioned above, the thickness of the bars is equal to the spacing therebetween which is also equal to the width of the transparent openings in the phase plate 230 and the spacings therebetween.

First the first section 430 is printed at the lowest speed, e.g., 13.33 inches per second (ips) from right to left. Next, the second section 432 is printed at the same speed from left to right. Then the third section 432 is printed at the next highest speed (16.67 ips) from right to left and the fourth section 436 is printed from left to right at the same speed. Finally, at the highest speed, e.g., 26.67 ips, the fourth section 438 is printed from right to left and then the sixth section 440 is printed from left to right at the that speed.

Next, the pattern 404 is scanned and a phase for each section is determined in the manner described above. The measured phase difference between sections allows for a correction due to speed as illustrated in FIG. 17(*e*).

Figure 19:
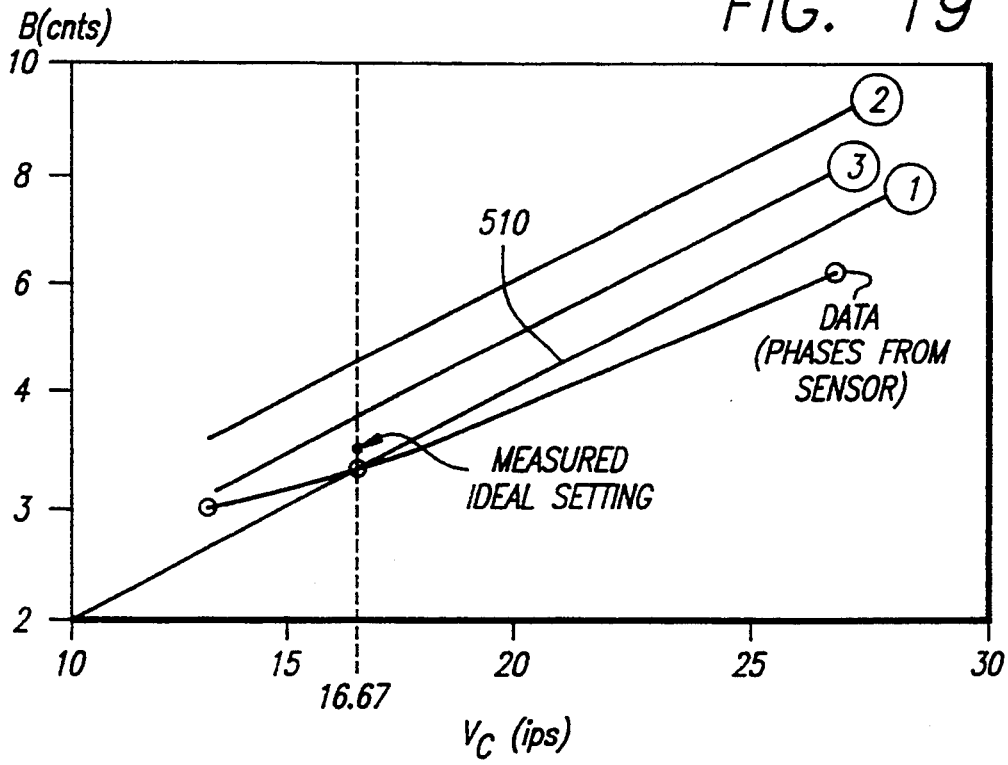
FIG. 19 is a graph of print image delay (B) versus carriage speed for the illustrative thermal inkjet printer of the present invention.

To correct for offsets in the scan axis, for a given speed, the difference in the phases between sections of the pattern associated with the two directions of travel is calculated and translated to a time of flight delay value B. The delay B for each speed is used to determine a least squares fit line 510 therebetween. This is illustrated in the graph of delay versus speed of FIG. 19. This least squares fit calculation results in the slope of the line 'm' and the B axis intercept '$B_o$'. In equation form:

$$B=mV_c+B_o \quad [1]$$

where m is the slope, $V_c$ is the speed or velocity, and $B_o$ is a constant which represents the B axis intercept. For a given speed, $V_c$, knowledge of the slope m and the constant $B_o$ allows for a calculation of the delay B required to correct for the offset. Correction for curvature is effected by adding an additional delay (e.g. 25% or 1.25×B). As illustrated in FIG. 17(*f*), this has the effect of joining the curved tails of the segments to create an image in which the curvature is less discernible to the naked eye of the casual observer.

Correction of Pen Offsets in the Media Axis and Between Pens

Another source of image misregistration derives from paper slippage on the roller or platen 154. In accordance with the present teachings, correction for paper or media slippage is effected by first printing the media axis test pattern 408 of the test pattern 40 of FIG. 5. As mentioned above, the thickness of the bars is equal to the spacing therebetween which is also equal to the width of the transparent openings in the phase plate 230 and the spacings therebetween. The pattern 408 includes five columns of vertically spaced horizontal bars 1–5. Each column has three rows segments 1–3. The first row in each column is created by scanning the carriage assembly 100 in the carriage axis and causing one cartridge (e.g., the cartridge containing cyan ink) to print. Thus, each column has a first row of cyan colored bars. In the second row, a different colored cartridge is activated in each column with the exception that the cyan cartridge 108 is activated in the second row of the first and fifth columns. Finally, the cyan cartridge is activated for the third row of each column in the pattern 408.

Media axis pen alignment is effected by scanning the pattern 408 with the sensor module 200 along the media axis, column by column and calculating phase data $P_{ij}$, in the manner described above, where i denotes the row and j denotes the column. The phase data is stored in a matrix as shown below:

$$\begin{bmatrix} P_{11} \ldots P_{15} \\ P_{21} \ldots P_{25} \\ P_{31} \ldots P_{35} \end{bmatrix} \quad [2]$$

Ideally, $P_{11}=P_{31}$. Thus, by comparing the phases of the first row to those of the third row, paper slippage or "walk" within one pen over a given distance may be detected and corrected in the manner described below.

Image registration between colors is calculated in the manner set forth below:

$$P_{m/c}=(P_{22}-P_{12})-\tfrac{1}{2}(P_{32}-P_{12}) \quad [3]$$

$$P_{y/c}=(P_{23}-P_{13})-\tfrac{1}{2}(P_{33}-P_{13}) \quad [4]$$

$$P_{k/c}=(P_{24}-P_{14})-\tfrac{1}{2}(P_{34}-P_{14}) \quad [5]$$

where:

$P_{m/c}$ represents pen offset in the media axis between the cyan pen 108 and the magenta pen 106, $P_{y/c}$ represents pen offset in the media axis between the cyan pen 108 and the yellow pen 104, and $P_{k/c}$ represents pen offset in the media axis between the cyan pen 108 and the black pen 102.

The pen offsets in the media axis between pens are corrected by selecting certain nozzles for activation. In FIG. 16, for example, initially nozzles 5 through 100 may be activated for all pens. As a result of the phase difference calculations, it may be necessary to activate nozzles 3–98 of the second pen 104, nozzles 1–96 of the third pen 106 and nozzles 7 through 102 of the fourth pen 108. This selective nozzle activation scheme has the effect of offsetting the images produced by the pen in the media axis.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. A method for creating a test pattern including the steps of:

moving a first inkjet pen in a first direction at a first speed;

printing a first plurality of vertical bars horizontally spaced while said pen is moving in said first direction at said first horizontal speed;

moving said first inkjet pen in said first direction at a second speed;

printing a second plurality of vertical bars horizontally spaced with said pen moving in said first direction at said second speed.

2. The invention of claim 1 further including the step of moving the first pen at first and second speeds in a second direction while printing said first and second plurality of vertical bars.

* * * * *